US011147148B2

(12) United States Patent
Ishii

(10) Patent No.: US 11,147,148 B2
(45) Date of Patent: Oct. 12, 2021

(54) X-RAY GENERATOR

(71) Applicant: HAMAMATSU PHOTONICS K.K., Hamamatsu (JP)

(72) Inventor: Atsushi Ishii, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 17/043,833

(22) PCT Filed: Feb. 18, 2019

(86) PCT No.: PCT/JP2019/005909
§ 371 (c)(1),
(2) Date: Sep. 30, 2020

(87) PCT Pub. No.: WO2019/198339
PCT Pub. Date: Oct. 17, 2019

(65) Prior Publication Data

US 2021/0100088 A1 Apr. 1, 2021

(30) Foreign Application Priority Data

Apr. 12, 2018 (JP) ..... JP2018-077003

(51) Int. Cl.
*H05G 1/06* (2006.01)

(52) U.S. Cl.
CPC ..... *H05G 1/06* (2013.01)

(58) Field of Classification Search
CPC ..... H05G 1/06
See application file for complete search history.

(56) References Cited

U.S. PATENT DOCUMENTS

2005/0190884 A1* 9/2005 Suzuki ..... H05G 1/06 378/101
2008/0107237 A1* 5/2008 Inazuru ..... H05G 1/06 378/140
2019/0318902 A1* 10/2019 Ishii ..... H05G 1/06

FOREIGN PATENT DOCUMENTS

JP S58-021948 U 2/1983
JP 2001-015294 A 1/2001
(Continued)

OTHER PUBLICATIONS

International Preliminary Report on Patentability dated Oct. 22, 2020 for PCT/JP2019/005909.

*Primary Examiner* — Chih-Cheng Kao
(74) *Attorney, Agent, or Firm* — Faegre Drinker Biddle & Reath LLP

(57) ABSTRACT

An X-ray generator includes an X-ray tube, an X-ray tube accommodation portion, and a power source unit having an internal substrate supplying a voltage to the X-ray tube sealed inside an insulating block. Insulating oil is enclosed in a space defined by an upper surface of the insulating block and an inner surface of the X-ray tube accommodation portion. A high-voltage power supply unit connected to a target support portion is disposed on the upper surface. At least one protrusion portion protruding to an insulating valve side beyond a boundary portion where the high-voltage power supply unit, the upper surface, and the insulating oil meet and surrounding the high-voltage power supply unit is provided on the upper surface. An apex portion of the protrusion portion is separated from an imaginary plane including an end portion of the insulating valve and extending in a direction orthogonal to a tube axis.

5 Claims, 5 Drawing Sheets

(56) References Cited

FOREIGN PATENT DOCUMENTS

| | | | |
|---|---|---|---|
| JP | 4231288 | B2 | 2/2009 |
| JP | 4889979 | B2 | 3/2012 |
| WO | WO-2018/198517 | A1 | 11/2018 |

* cited by examiner

X-RAY GENERATOR

TECHNICAL FIELD

An aspect of the present disclosure relates to an X-ray generator.

BACKGROUND ART

In the related art, a configuration in which a metal container (X-ray tube accommodation portion) accommodating an X-ray tube and insulating oil is placed on an upper surface of an insulating block is known (for example, refer to Patent Literature 1 and Patent Literature 2). A high-voltage generation circuit for supplying a voltage to the X-ray tube is molded in the insulating block.

Patent Literature 1 discloses a configuration in which an annular wall portion 2E that surrounds the area in the vicinity of a high-voltage application portion protruding from a valve portion of an X-ray tube and protrudes to shield the high-voltage application portion from a metal tubular member (X-ray tube accommodation portion) is provided on an upper surface of an insulating block. Patent Literature 2 discloses a configuration in which an annular wall portion 13h surrounding a base end portion (high-voltage application portion) of a rod-shaped anode is provided on an upper surface of an insulating block. Such a wall portion curbs discharging from the high-voltage application portion to an X-ray tube accommodation portion and plays a role of curbing creepage discharging by increasing a creepage distance on the upper surface of the insulating block.

CITATION LIST

Patent Literature

[Patent Literature 1] Japanese Patent No. 4231288
[Patent Literature 2] Japanese Patent No. 4889979

SUMMARY OF INVENTION

Technical Problem

However, in the wall portions disclosed in Patent Literature 1 and Patent Literature 2, if a wall portion is formed to surround a region between a valve portion of an X-ray tube and an upper surface of an insulating block, there is a possibility that circulation of insulating oil inside an X-ray tube accommodation portion may be hindered by the wall portion. Specifically, there is a possibility that insulating oil which has come into contact with a high-voltage application portion of the X-ray tube and heated is likely to stay within the region. As a result, there is concern that cooling efficiency of the X-ray tube may deteriorate.

Here, an object of an aspect of the present disclosure is to provide an X-ray generator capable of curbing deterioration in cooling efficiency of an X-ray tube while creepage discharging on a surface of an insulating block is curbed.

Solution to Problem

According to an aspect of the present disclosure, there is provided an X-ray generator including an X-ray tube having a valve portion and a high-voltage application portion provided in the valve portion in a protruding manner, an X-ray tube accommodation portion accommodating the valve portion such that at least the valve portion is surrounded when viewed in a tube axis direction along a tube axis of the X-ray tube, and a power source unit having a high-voltage generation circuit supplying a voltage to the X-ray tube sealed inside a solid insulating block made of an insulative material. An insulating liquid is enclosed in a space defined by a surface of the insulating block facing the X-ray tube and an inner surface of the X-ray tube accommodation portion. A conductive power supply unit electrically connected to the high-voltage application portion is disposed on the surface of the insulating block. At least one protrusion portion protruding to the valve portion side beyond a boundary portion where the power supply unit, the surface of the insulating block, and the insulating liquid meet and surrounding the power supply unit when viewed in the tube axis direction is provided on the surface of the insulating block. An apex portion of the at least one protrusion portion is separated from an imaginary plane including an end portion of the valve portion on the surface side and extending in a direction orthogonal to the tube axis.

In the X-ray generator according to the aspect of the present disclosure, the boundary portion between the conductive power supply unit and insulating materials of two different kinds (the surface of the insulating block and the insulating liquid) is a part in which an electric field is likely to be concentrated and discharging is likely to occur. Here, in the X-ray generator, a protrusion portion protruding to the valve portion side beyond the boundary portion and surrounding the power supply unit is provided on the surface of the insulating block facing the valve portion of the X-ray tube. Due to such a protrusion portion, the boundary portion can be concealed from the X-ray tube accommodation portion surrounding the X-ray tube. Accordingly, discharging between the boundary portion and the X-ray tube accommodation portion can be curbed. In addition, compared to a case in which the surface of the insulating block is a flat surface, a creepage distance on the surface of the insulating block can be lengthened by providing the protrusion portion on the surface of the insulating block. Accordingly, creepage discharging on the surface of the insulating block can be curbed. Meanwhile, the apex portion of the protrusion portion is separated from an imaginary plane including the end portion of the valve portion on the surface side and extending in a direction orthogonal to the tube axis. Accordingly, circulation of the insulating liquid is prevented from being hindered in a region between the valve portion of the X-ray tube and the surface of the insulating block, and deterioration in cooling efficiency of the X-ray tube can be curbed. As described above, according to the X-ray generator, deterioration in cooling efficiency of the X-ray tube can be curbed while creepage discharging on the surface of the insulating block is curbed.

The surface of the insulating block may have a surface shape varying continuously. In this manner, according to the configuration in which no corner portions (that is, parts in which an electric field is likely to be concentrated and discharging is likely to occur) varying in a non-continuous manner are provided on the surface of the insulating block, concentration of an electric field in a particular part (corner portion) on the surface of the insulating block can be curbed, and thus occurrence of discharging can be curbed more effectively.

The at least one protrusion portion may include a first protrusion portion having an annular shape surrounding the power supply unit in the vicinity of the power supply unit. According to this configuration, since the boundary portion can be appropriately shielded from the X-ray tube accommodation portion by the first protrusion portion, discharging between the boundary portion and the X-ray tube accommodation portion can be curbed more effectively.

The at least one protrusion portion may include a second protrusion portion having an annular shape forming a groove portion between the second protrusion portion and the inner surface of the X-ray tube accommodation portion. According to this configuration, due to the second protrusion portion, the creepage distance on the surface of the insulating block can be extended effectively.

An annular recess portion surrounding the power supply unit and an inclination portion connected to the recess portion and being inclined toward the recess portion while being separated from the imaginary plane in the tube axis direction may be provided on the surface of the insulating block. According to this configuration, foreign substances or the like occurring in insulating oil can be guided to the recess portion by being moved along the inclination portion. Accordingly, occurrence of discharging caused by foreign substances or the like in insulating oil can be curbed.

Advantageous Effects of Invention

According to the aspect of the present disclosure, it is possible to provide an X-ray generator capable of curbing deterioration in cooling efficiency of an X-ray tube while creepage discharging on a surface of an insulating block is curbed.

DESCRIPTION OF EMBODIMENT

Figure 1:
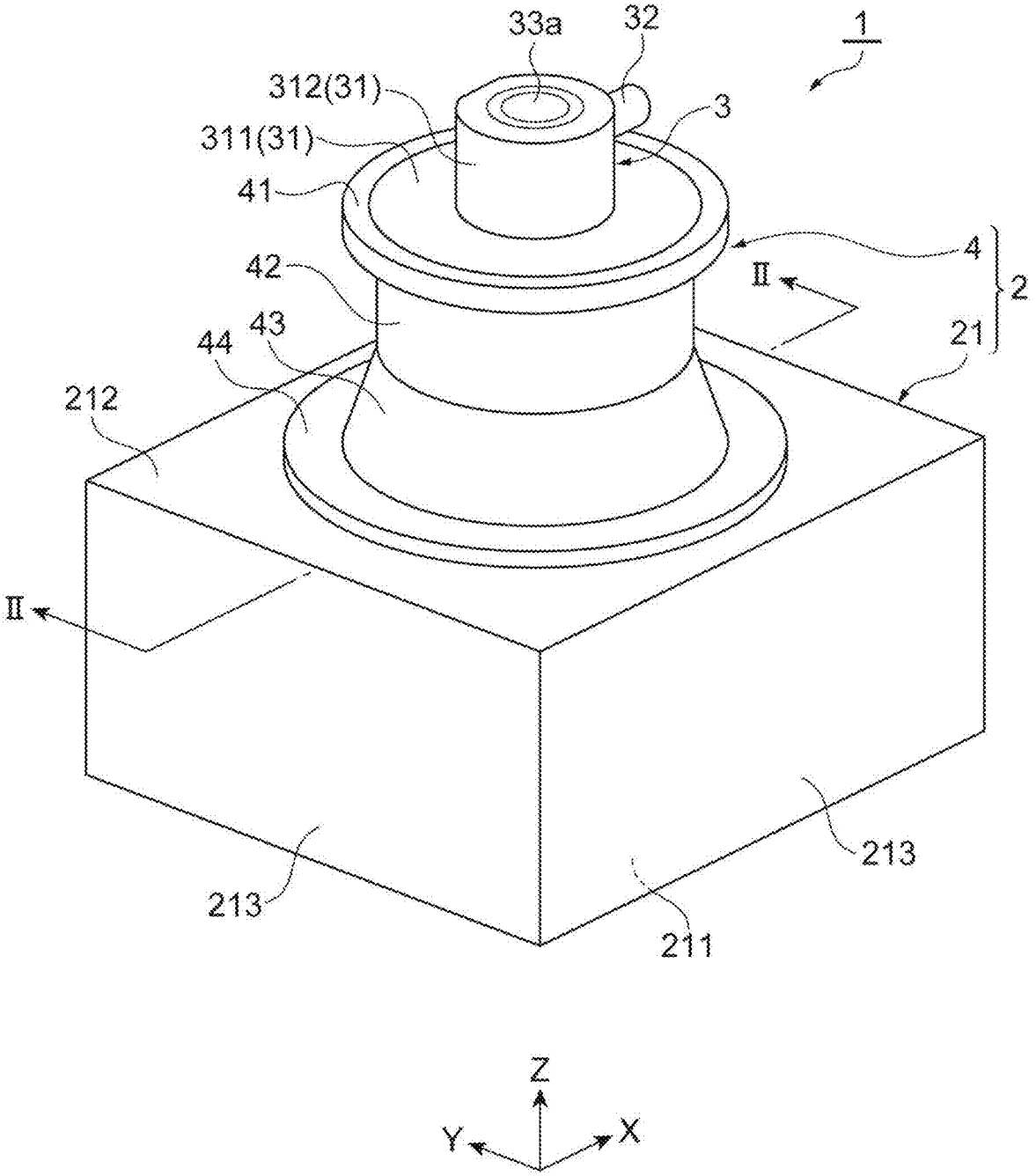
FIG. 1 is a perspective view showing an appearance of an X-ray generator of an embodiment.

Hereinafter, an embodiment of the present disclosure will be described in detail with reference to the drawings. The same reference signs are applied to parts which are the same or corresponding in each diagram, and duplicate description will be omitted. In addition, words indicating predetermined directions, such as "upward" and "downward", are based on the states shown in the drawings and are used for the sake of convenience.

Figure 2:
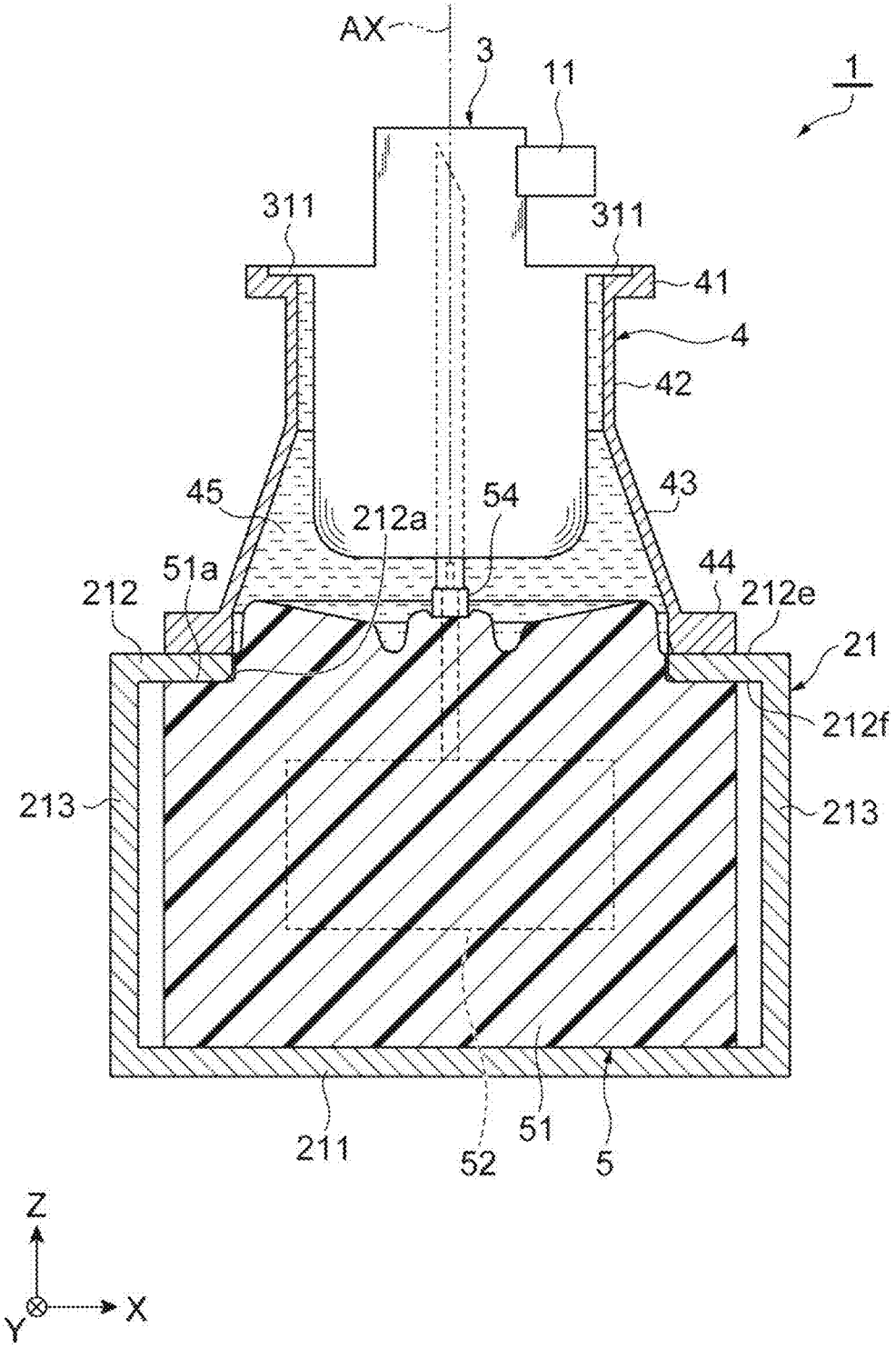
FIG. 2 is a cross-sectional view along line II-II in FIG. 1.

FIG. 1 is a perspective view showing an appearance of an X-ray generator according to the embodiment of the present disclosure. FIG. 2 is a cross-sectional view along line II-II in FIG. 1. For example, an X-ray generator 1 shown in FIGS. 1 and 2 is a micro-focus X-ray source used in a non-destructive X-ray test in which an internal structure of a test object is observed. The X-ray generator 1 has a casing 2. Inside the casing 2, an X-ray tube 3 generating X-rays and a power source unit 5 supplying power to the X-ray tube 3 are mainly accommodated. The casing 2 has an X-ray tube accommodation portion 4 accommodating a part of the X-ray tube 3, and an accommodation portion 21.

The accommodation portion 21 is a part mainly accommodating the power source unit 5. The accommodation portion 21 has a bottom wall portion 211, an upper wall portion 212, and side wall portions 213. Each of the bottom wall portion 211 and the upper wall portion 212 has a substantially square shape. Edge portions of the bottom wall portion 211 and edge portions of the upper wall portion 212 are joined to each other with four side wall portions 213 therebetween. Accordingly, the accommodation portion 21 is formed to have a substantially rectangular parallelepiped shape. In the present embodiment, for the sake of convenience, a direction in which the bottom wall portion 211 and the upper wall portion 212 face each other will be defined as a Z direction, the bottom wall portion 211 side will be defined as a downward side, and the upper wall portion 212 side will be defined as an upward side. In addition, directions which are orthogonal to the Z direction and in which the side wall portions 213 facing each other face each other will be referred to as an X direction and a Y direction, respectively. In a central portion of the upper wall portion 212 viewed in the Z direction, an opening portion 212*a* (circular penetration hole) is provided.

The X-ray tube accommodation portion 4 is formed of a metal having high heat conductivity (high heat dissipation). Examples of a material of the X-ray tube accommodation portion 4 include aluminum, iron, copper, and an alloy including these. In the present embodiment, the material of the X-ray tube accommodation portion 4 is aluminum (or an alloy thereof). The X-ray tube accommodation portion 4 has a tubular shape having openings on both ends of the X-ray tube 3 in a tube axis direction (Z direction). A tube axis of the X-ray tube accommodation portion 4 coincides with a tube axis AX of the X-ray tube 3. The X-ray tube accommodation portion 4 has a holding portion 41, a cylindrical portion 42, a tapered portion 43, and a flange portion 44. The holding portion 41 is a part holding the X-ray tube 3 in a flange portion 311 using a fixing member (not shown in the diagram) and air-tightly seals the X-ray tube 3 together with an upper opening of the X-ray tube accommodation portion 4. The cylindrical portion 42 is a part connected to a lower end of the holding portion 41 and formed to have a cylindrical shape including a wall surface extending in the Z direction. The tapered portion 43 is a part connected to an end portion of the cylindrical portion 42 and includes a wall surface which increases in diameter continuously and gently while going away from the cylindrical portion 42 in the Z direction from the end portion. The cylindrical portion 42 and the tapered portion 43 are connected to each other such that an angle formed between the wall surfaces of the cylindrical portion 42 and the tapered portion 43 individually having a flat surface shape in cross sections along a ZX plane and a ZY plane becomes an obtuse angle. The flange portion 44 is a part connected to an end portion of the tapered portion 43 and extending to the outward side when viewed in the Z direction. The flange portion 44 is constituted as a ring-shaped member having a wall thickness thicker than those of the cylindrical portion 42 and the tapered portion 43. Accordingly, it has a large heat capacity, and thus the heat dissipation is improved. The flange portion 44 is air-tightly fixed to an upper surface 212*e* of the upper wall portion 212 at a position surrounding the opening portion 212*a* of the upper wall portion 212 when viewed in the Z direction. In the present embodiment, the flange portion 44 is thermally connected to the upper surface 212*e* of the upper wall portion 212 (comes into contact with the upper surface 212*e* of the upper wall portion 212 in a thermally conductive manner). Insulating oil 45 (electrically insulating liquid) is air-tightly enclosed inside the X-ray tube accommodation portion 4 (fills the inside of the X-ray tube accommodation portion 4).

The power source unit 5 is a part supplying power within a range of approximately several kV to several hundreds of kV to the X-ray tube 3. The power source unit 5 has an insulating block 51 made of a solid epoxy resin and having electrical insulating properties, and an internal substrate 52 including a high-voltage generation circuit molded inside the insulating block 51. The insulating block 51 is formed to have a substantially rectangular parallelepiped shape. An upper surface central portion of the insulating block 51 penetrates the opening portion 212*a* of the upper wall portion 212 and protrudes. Meanwhile, an upper surface edge portion 51*a* of the insulating block 51 is air-tightly fixed to a lower surface 212*f* of the upper wall portion 212. A high-voltage power supply unit 54 including a cylindrical socket electrically connected to the internal substrate 52 is disposed on the upper surface central portion of the insulating block 51. The power source unit 5 is electrically connected to the X-ray tube 3 via the high-voltage power supply unit 54.

The outer diameter of a part (that is, the upper surface central portion) of the insulating block 51 inserted through opening portion 212*a* is the same as or slightly smaller than the inner diameter of the opening portion 212*a*.

Figure 3:
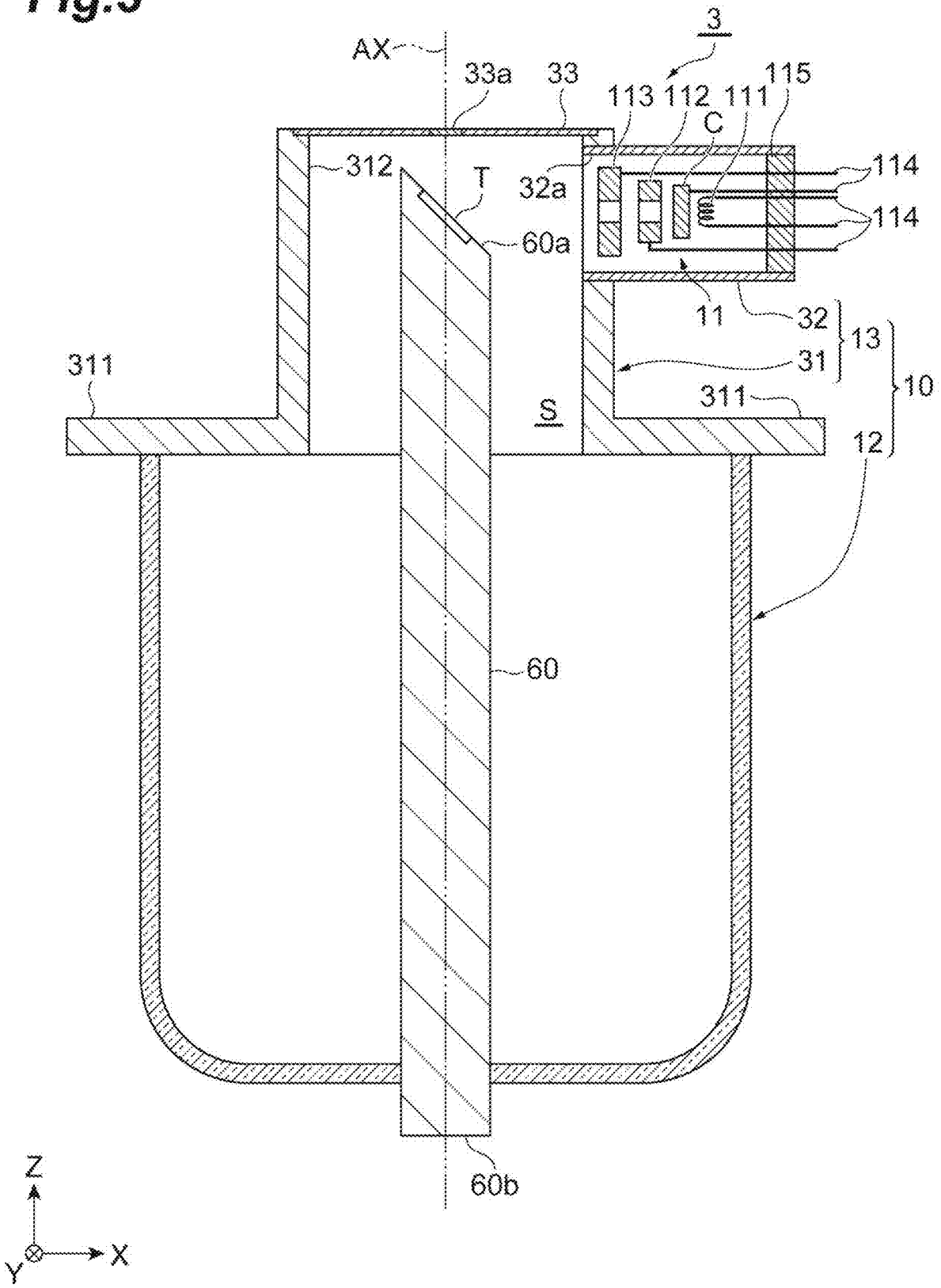
FIG. 3 is a cross-sectional view showing a configuration of an X-ray tube.

Next, a configuration of the X-ray tube 3 will be described. As shown in FIG. 3, the X-ray tube 3 is an X-ray tube which is referred to as a so-called reflection X-ray tube. The X-ray tube 3 includes a vacuum casing 10 serving as a vacuum envelope maintaining the inside in a vacuum state, an electron gun 11 serving as an electron generation unit, and a target T. For example, the electron gun 11 has a cathode C obtained by impregnating a base body made of a metal material or the like having a high-melting point with a substance easily emitting electrons. In addition, for example, the target T is a plate-shaped member made of a metal material having a high-melting point, such as tungsten. The center of the target T is positioned on the tube axis AX of the X-ray tube 3. The electron gun 11 and the target T are accommodated inside the vacuum casing 10, and X-rays are generated when electrons emitted from the electron gun 11 are incident on the target T. X-rays are generated radially from the target T (origin). In components of X-rays toward an X-ray emission window 33*a* side, X-rays drawn out to the outside through the X-ray emission window 33*a* are utilized as required X-rays.

The vacuum casing 10 is mainly constituted of an insulating valve 12 (valve portion) formed of an insulative material (for example, glass), and a metal portion 13 having the X-ray emission window 33*a*. The metal portion 13 has a main body portion 31 in which the target T (anode) is accommodated, and an electron gun accommodation portion 32 in which the electron gun 11 (cathode) is accommodated.

The main body portion 31 is formed to have a tubular shape and has an internal space S. A lid plate 33 having the X-ray emission window 33*a* is fixed to one end portion (outer end portion) of the main body portion 31. The material of the X-ray emission window 33*a* is a radiotranslucent material and is beryllium or aluminum, for example. The lid plate 33 closes one end side of the internal space S. The main body portion 31 has the flange portion 311 and a cylindrical portion 312. The flange portion 311 is provided on the outer circumference of the main body portion 31. The flange portion 311 is a part fixed to the holding portion 41 of the X-ray tube accommodation portion 4 described above. The cylindrical portion 312 is a part formed to have a cylindrical shape on one end portion side of the main body portion 31.

The electron gun accommodation portion 32 is formed to have a cylindrical shape and is fixed to a side portion of the main body portion 31 on one end portion side. The central axis of the main body portion 31 (that is, the tube axis AX of the X-ray tube 3) and the central axis of the electron gun accommodation portion 32 are substantially orthogonal to each other. The inside of the electron gun accommodation portion 32 communicates with the internal space S of the main body portion 31 through an opening 32*a* provided at an end portion of the electron gun accommodation portion 32 on the main body portion 31 side.

The electron gun 11 includes the cathode C, a heater 111, a first grid electrode 112, and a second grid electrode 113, and thereby the diameter of an electron beam generated by cooperation between these configurations can be reduced (micro-focusing can be performed). The cathode C, the heater 111, the first grid electrode 112, and the second grid electrode 113 are attached to a stem substrate 115 through a plurality of power supply pins 114 extending parallel to each other. Power is supplied to each of the cathode C, the heater 111, the first grid electrode 112, and the second grid electrode 113 from the outside through the corresponding power supply pin 114.

The insulating valve 12 is formed to have a substantially tubular shape. One end side of the insulating valve 12 is connected to the main body portion 31. In the insulating valve 12, a target support portion 60 in which the target T is fixed to a tip is held on the other end side thereof. For example, the target support portion 60 is formed of a copper material or the like in a columnar shape and extends in the Z direction. An inclined surface 60*a* being inclined away from the electron gun 11 while it goes from the insulating valve 12 side toward the main body portion 31 side is formed on the tip side of the target support portion 60. The target T is embedded in an end portion of the target support portion 60 in a manner of being flush with the inclined surface 60*a*.

A base end portion 60*b* of the target support portion 60 protrudes to the outward side beyond the lower end portion of the insulating valve 12 in a columnar shape and is connected to the high-voltage power supply unit 54 of the power source unit 5 (refer to FIG. 2). That is, a high-voltage application portion (in the present embodiment, the base end portion 60*b*) to which a voltage is applied by the high-voltage power supply unit 54 is provided in the insulating valve 12 in a protruding manner. In the present embodiment, the vacuum casing 10 (metal portion 13) has a ground potential, and the high-voltage power supply unit 54 supplies a high positive voltage to the target support portion 60. However, a form of applying a voltage is not limited to the foregoing example.

Figure 4:
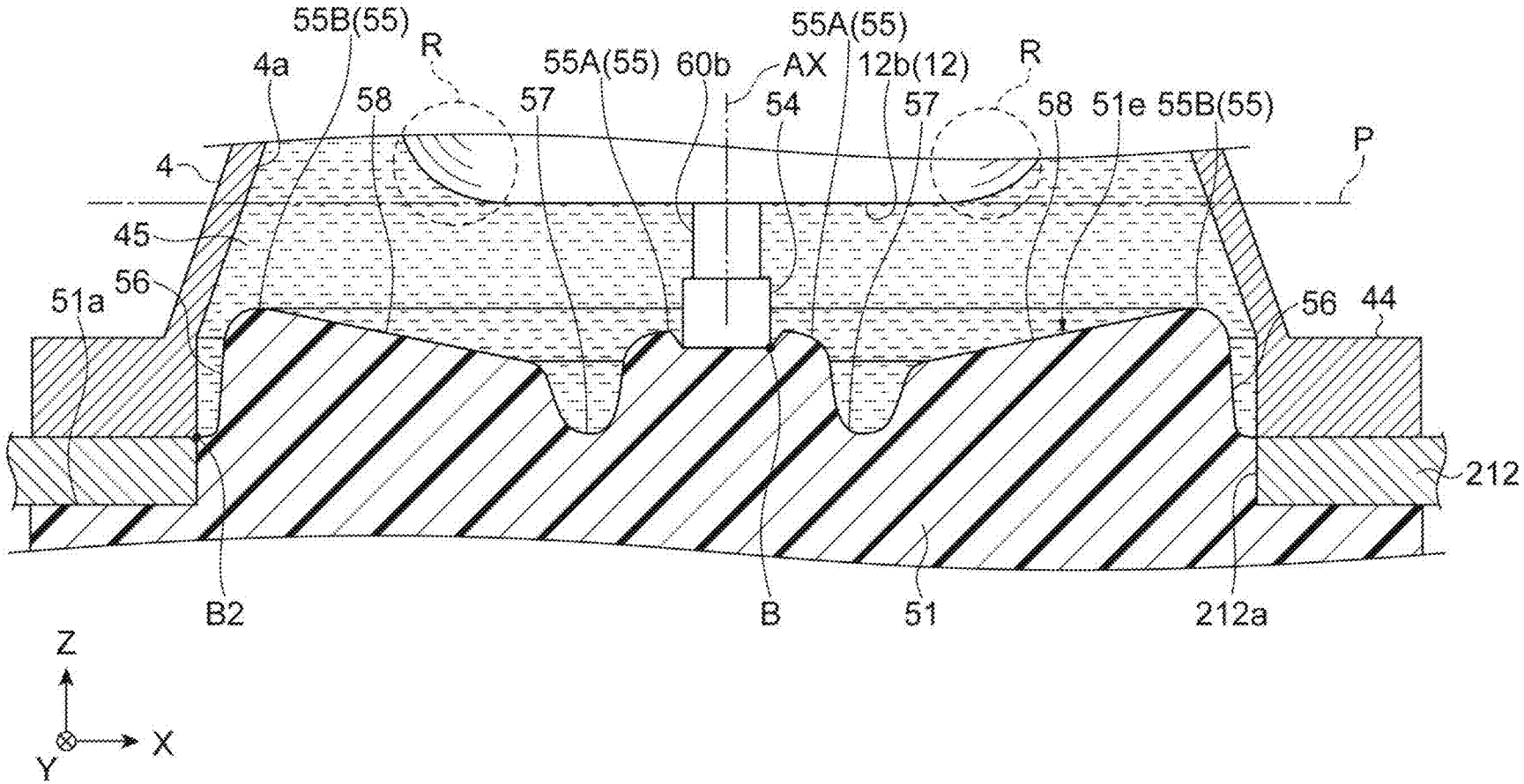
FIG. 4 is a cross-sectional view showing a structure of an upper surface of an insulating block.

Next, with reference to FIG. 4, the shape of the upper surface of the insulating block 51 will be described in detail. As described above, the insulating oil 45 is enclosed in a space defined by an upper surface 51*e* (surface) of the insulating block 51 facing the X-ray tube 3 and an inner surface 4*a* of the X-ray tube accommodation portion 4. The upper surface 51*e* is a surface including the upper surface central portion and the upper surface edge portion 51*a* described above. However, in the present embodiment, the part, which mainly defines the foregoing space where the insulating oil 45 is enclosed, is particularly a part which penetrates the opening portion 212*a*, protrudes, and enters the inward side of the X-ray tube accommodation portion 4 on the upper surface 51*e*.

At least one annular protrusion portion 55 surrounding the high-voltage power supply unit 54 is provided on the upper surface 51*e* of the insulating block 51. The protrusion portion 55 is a part protruding to the insulating valve 12 side beyond a boundary portion B where the high-voltage power supply unit 54, the upper surface 51*e* of the insulating block 51, and the insulating oil 45 meet. The protrusion portion 55 is provided in a toric shape centering on the tube axis AX. The protrusion portion 55 protrudes with an arc-shaped apex portion when viewed in a direction orthogonal to the tube axis direction (Z direction). The boundary portion B is present in an annular shape along a lower end edge portion of the high-voltage power supply unit 54. In the present embodiment, the protrusion portion 55 includes a protrusion portion 55A (first protrusion portion) covering and concealing the boundary portion B, and a protrusion portion 55B (second protrusion portion) provided on a side outward from the protrusion portion 55A.

The protrusion portion 55A is an annular protrusion portion provided such that the high-voltage power supply unit 54 is directly surrounded in the vicinity of the high-voltage power supply unit 54. The protrusion portion 55A is provided such that the boundary portion B is directly surrounded, covered, and concealed from the surroundings. The high-voltage power supply unit 54 is stored inside a hollow portion (recess portion) formed in a central region on the inward side of the protrusion portion 55A. Due to this protrusion portion 55A provided in the vicinity of the high-voltage power supply unit 54, the boundary portion B is shielded from the inner surface 4*a* of the X-ray tube accommodation portion 4. More specifically, the boundary portion B is shielded such that it cannot be directly seen from the inner surface 4*a* of the X-ray tube accommodation portion 4 in a state in which the X-ray tube 3 is connected to the high-voltage power supply unit 54.

The protrusion portion 55B is an annular protrusion portion provided such that an annular groove portion 56 is formed between the protrusion portion 55B and the inner surface 4*a* (separated from the inner surface 4*a* with a groove portion 56 therebetween) at a position near the inner surface 4*a* of the X-ray tube accommodation portion 4. The protrusion portion 55B does not face the insulating valve 12 when viewed in the tube axis direction (Z direction). More specifically, the protrusion portion 55B is provided at a position away from the insulating valve 12 in a direction orthogonal to the tube axis AX such that it does not face an end portion 12*b* of the insulating valve 12 on the upper surface 51*e* side (power source unit 5 side) and corner portions R of an outer edge portion thereof when viewed in the tube axis direction. A boundary portion B2 where the inner surface 4*a* of the X-ray tube accommodation portion 4 (and the upper surface 212*e* of the upper wall portion 212), the upper surface 51*e* of the insulating block 51, and the insulating oil 45 meet in an annular shape is present in a bottom portion of the groove portion 56. That is, the boundary portion B2 is in a state of being covered and concealed by the protrusion portion 55B from the surroundings and is shielded such that it cannot be directly seen particularly from the high-voltage power supply unit 54, the high-voltage application portion (base end portion 60*b*) of the X-ray tube 3, and the boundary portion B. In the present embodiment, the apex portion of the protrusion portion 55B is at a position higher than the apex portion of the protrusion portion 55A. In other words, the apex portion of the protrusion portion 55B is at a position closer to an imaginary plane P including the end portion 12*b* of the insulating valve 12 and extending in a direction orthogonal to the tube axis AX than the apex portion of the protrusion portion 55A. However, the apex portion of the protrusion portion 55A may be at a position higher than the apex portion of the protrusion portion 55B (closer to the imaginary plane P). In the present embodiment, the groove portion 56 is surrounded by the protrusion portion 55B and the inner surface 4*a* of the flange portion 44 and is formed to have an annular shape such that the area in the vicinity of the protrusion portion 55B is encircled (separated from the inner surface 4*a* throughout the whole circumference).

Meanwhile, the apex portions of the protrusion portion 55A and the protrusion portion 55B are separated from the imaginary plane P when viewed in a direction orthogonal to the tube axis direction (Z direction). In other words, when viewed in a direction orthogonal to the tube axis direction (Z direction), the apex portions of the protrusion portion 55A and the protrusion portion 55B are positioned on a side closer to the upper surface 51*e* side (a side closer to the power source unit 5) than the end portion 12*b* of the insulating valve 12. In addition, the upper surface 51*e* of the insulating block 51 is not present between the end portion 12*b* of the insulating valve 12 and the apex portion of the protrusion portion 55B (that is, the apex portion of a protrusion portion of the protrusion portions 55 at the highest position). That is, every part on the upper surface 51*e* is positioned below the end portion 12*b* (imaginary plane P) of the insulating valve 12 in a direction extending in the tube axis direction (Z direction). That is, no wall portion hindering circulation of the insulating oil 45 is provided on the upper surface 51*e*. For example, a wall portion hindering circulation of the insulating oil 45 indicates an annular wall portion (shield) protruding to a position at the same height as the end portion 12*b* of the insulating valve 12 or higher than the end portion 12*b* such that a part between the high-voltage application portion and the X-ray tube accommodation portion 4 is shielded in the vicinity (typically, a position where the insulating valve 12 is surrounded when viewed in the Z direction) of the high-voltage application portion of the X-ray tube 3.

In addition, a recess portion 57 and an inclination portion 58 are provided on the upper surface 51*e* of the insulating block 51. The recess portion 57 is provided in an annular shape having an arc-shaped cross section when viewed in a direction orthogonal to the tube axis direction (Z direction) such that the high-voltage power supply unit 54 is surrounded. In the present embodiment, as shown in FIG. 4, the recess portion 57 is provided such that it is connected to the protrusion portion 55A on the outward side of the protrusion portion 55A. That is, an outer surface of the protrusion portion 55A and an inner surface of the recess portion 57 are connected to each other. The recess portion 57 is hollow on the inward side (internal substrate 52 (refer to FIG. 2) side) of the insulating block 51 from the boundary portion B when viewed in a direction orthogonal to the tube axis direction (Z direction).

The inclination portion 58 is a part occupying a great part of the upper surface central portion of the insulating block 51 and connects the recess portion 57 and the protrusion portion 55B to each other. The inclination portion 58 is formed into a continuous plane extending from the protrusion portion 55B toward the recess portion 57. The inclination portion 58 inclines with respect to a plane (XY plane) orthogonal to the tube axis direction (Z direction). Specifically, the inclination portion 58 is an inclined surface being continuously inclined toward the recess portion 57 from the protrusion portion 55B while being separated from the imaginary plane P along the tube axis AX (that is, going downward in a direction extending in the tube axis direction (Z direction) in FIG. 4). In other words, the inclination portion 58 is an inclined surface being inclined toward the recess portion 57 while it goes from the insulating valve 12 side toward the insulating block 51 side along the tube axis AX. In addition, the corner portions R of the insulating valve 12 face the inclination portion 58 (flat surface) and do not face the protrusion portion 55.

The upper surface 51*e* on which the protrusion portion 55, the recess portion 57, and the inclination portion 58 described above are provided has a surface shape varying continuously from the boundary portion B toward the inner surface 4*a* of the X-ray tube accommodation portion 4. That is, no corner portions varying in a non-continuous manner over an area from the protrusion portion 55A to the protrusion portion 55B are provided on the upper surface 51*e*. All of the protrusion portion 55, the recess portion 57, and the inclination portion 58 described above are provided in circular symmetry (in rotational symmetry with respect to an arbitrary angle within a range of 0 degrees to 360 degrees) centering on the tube axis AX of the X-ray tube 3 (refer to FIG. 2). Accordingly, the upper surface 51*e* in its entirety has a circularly symmetric shape centering on the tube axis AX of the X-ray tube 3. More specifically, on the upper surface 51*e* of the insulating block 51, a central annular portion (protrusion portion 55A) in which a hollow portion is formed at the center of a projection portion having a substantially truncated cone shape surrounded by the recess portion 57, and an outer circumferential annular portion sandwiched between the groove portion 56 and the recess portion 57 and including a plane (inclination portion 58) being inclined in a descending manner toward the tube axis AX from the protrusion portion 55B to the recess portion 57 are formed. Both the central annular portion and the outer circumferential annular portion have a circularly symmetric shape centering on the tube axis AX, and end edge portions thereof have a chamfered arc shape.

Effects

Next, effects according to the aspect of the present embodiment will be described. In the X-ray generator 1, the boundary portion B between the conductive high-voltage power supply unit 54 and insulating materials of two different kinds (the upper surface 51*e* of the solid insulating block 51 and the insulating oil 45) is a part in which an electric field is likely to be concentrated and discharging is likely to occur. Here, in the X-ray generator 1, the protrusion portion 55 protruding to the insulating valve 12 side beyond the boundary portion B and surrounding the high-voltage power supply unit 54 is provided on the upper surface 51*e* of the insulating block 51 facing the insulating valve 12 of the X-ray tube 3. Due to such a protrusion portion 55, the boundary portion B can be concealed from the X-ray tube accommodation portion 4 surrounding the X-ray tube 3. Accordingly, discharge between the boundary portion B having a high potential and the X-ray tube accommodation portion 4 having the ground potential (0 V) can be curbed.

In addition, compared to a case in which the upper surface 51*e* of the insulating block 51 is a flat surface, a creepage distance on the upper surface 51*e* of the insulating block 51 can be lengthened by providing the protrusion portion 55 on the upper surface 51*e* of the insulating block 51. Accordingly, creepage discharging on the surface of the insulating block 51 can be curbed. Meanwhile, the apex portion of the protrusion portion 55 is separated from the imaginary plane P including the end portion 12*b* of the insulating valve 12 and extending in a direction orthogonal to the tube axis AX when viewed in a direction orthogonal to the tube axis direction (Z direction). That is, a part protruding above the end portion 12*b* (imaginary plane P) of the insulating valve 12 on the upper surface 51*e* side is not provided on the upper surface 51*e* of the insulating block 51. Specifically, as described above, a wall portion (shield) hindering circulation of the insulating oil 45 is not provided on the upper surface 51*e*. Accordingly, circulation of the insulating oil 45 is prevented from being hindered in a region between the insulating valve 12 of the X-ray tube 3 and the upper surface 51*e* of the insulating block 51. That is, the insulating oil 45 can circulate smoothly in a region sandwiched between the insulating valve 12 of the X-ray tube 3 and the protrusion portion 55. As a result, deterioration in cooling efficiency of the X-ray tube 3 can be curbed. As described above, according to the X-ray generator 1, deterioration in cooling efficiency of the X-ray tube 3 can be curbed while creepage discharging on the surface of the insulating block 51 is curbed.

In addition, the upper surface 51*e* of the insulating block 51 has a surface shape varying continuously. In this manner, according to the configuration in which no corner portions (that is, parts in which an electric field is likely to be concentrated and discharging is likely to occur) varying in a non-continuous manner are provided on the upper surface 51*e* of the insulating block 51, concentration of an electric field in a particular part (corner portion) on the surface of the insulating block 51 can be curbed, and thus occurrence of discharging can be curbed more effectively. In addition, in the present embodiment, in a region on the upper surface 51*e* coming into contact with the insulating oil 45, a surface (a curved surface or an inclined surface) having a longer creepage distance throughout the entire region thereof than a flat surface is formed. In this manner, since a surface shape having a longer creepage distance than a flat surface is continuously formed over the entire area of the region on the upper surface 51*e* coming into contact with the insulating oil 45, creepage discharging is curbed effectively.

In addition, the protrusion portion 55 includes the annular protrusion portion 55A surrounding the high-voltage power supply unit 54 in the vicinity of the high-voltage power supply unit 54. The boundary portion B can be appropriately shielded from the X-ray tube accommodation portion 4 by the protrusion portion 55A. Accordingly, discharging between the boundary portion B and the inner surface 4*a* of the X-ray tube accommodation portion 4 can be curbed more effectively.

In addition, the protrusion portion 55 includes the annular protrusion portion 55B forming the groove portion 56 between the protrusion portion 55B and the inner surface 4*a* of the X-ray tube accommodation portion 4. Due to the protrusion portion 55B, the creepage distance on the surface of the insulating block 51 can be extended effectively. In addition, the protrusion portion 55B covers and conceals the boundary portion B2 in the bottom portion of the groove portion 56 from the surroundings. The protrusion portion 55B shields the boundary portion B2 such that it cannot be directly seen particularly from the high-voltage power supply unit 54, the high-voltage application portion (base end portion 60*b*) of the X-ray tube 3, and the boundary portion B. The boundary portion B2 is also a part in which discharging is likely to occur between the boundary portion B2 and high potential regions such as the high-voltage power supply unit 54, the high-voltage application portion (base end portion 60*b*) of the X-ray tube 3, and the boundary portion B. Therefore, discharging can be curbed effectively by the protrusion portion 55B shielding a discharge path. In addition, the corner portions R of the insulating valve 12 are also parts of a strong electric field and are parts having a high possibility of occurrence of discharging. However, since the protrusion portion 55B is provided at a position away from the insulating valve 12 in a direction orthogonal to the tube axis AX such that it does not face the corner portions R when viewed in the tube axis direction (Z direction), occurrence of discharging is curbed effectively. In the X-ray tube accommodation portion 4 as well, since the tapered portion 43 is formed, a region facing the corner portions R is separated from the corner portions R. That is, occurrence of discharging can be curbed more effectively by expanding the spaces in the vicinity of the corner portions R (by expanding the distances between the corner portions R and other configurations) in cooperation with disposition of the protrusion portion 55B and the tapered portion 43. The corner portions R and other configurations can also be separated from each other by simply increasing the size of the X-ray tube accommodation portion 4. However, in such a case, the capacity of the insulating oil 45 also increases more than necessary, and thus there is a possibility that the insulating oil 45 itself may act as a heat insulating material or is likely to stay. As a result, there is a possibility that the cooling efficiency of the X-ray tube 3 may deteriorate.

In addition, on the upper surface 51*e* of the insulating block 51, the annular recess portion 57 surrounding the high-voltage power supply unit 54, and the inclination portion 58 connected to the recess portion 57 and being inclined toward the recess portion 57 while being separated from the imaginary plane P in the tube axis direction (Z direction) are provided. For example, when the X-ray generator 1 is used in the direction shown in FIG. 4 (a state in which the upper surface 51*e* of the insulating block 51 is directed upward), foreign substances occurring in the insulating oil 45 can be guided to the recess portion 57 by being moved along the inclination portion 58. Accordingly, foreign substances which may cause an insulation breakdown can be concealed from the boundary portion B. As a result, occurrence of discharging caused by foreign substances in the insulating oil 45 can be curbed. In addition, when the X-ray generator 1 used in a direction opposite to the direction shown in FIG. 4 (a state in which the upper surface 51*e* of the insulating block 51 is directed downward), even if a small number of air bubbles occur in the insulating oil 45, these air bubbles can be guided to the recess portion 57 by being raised along the inclination portion 58. Accordingly, air bubbles which may cause an insulation breakdown can be concealed from the boundary portion B. As a result, occurrence of discharging caused by air bubbles in the insulating oil 45 can be curbed. In addition, discharging caused by the corner portions R can be curbed by causing the corner portions R of the insulating valve 12 to face the inclination portion 58 (flat surface) instead of the protrusion portion 55.

Hereinabove, the embodiment of the present disclosure has been described. However, the present disclosure is not limited to the foregoing embodiment, and the present disclosure can be subjected to various deformations within a range not departing from the gist thereof. That is, the shape, the material, and the like of each of the units and the portions of the X-ray generator are not limited to the specific shapes, materials, and the like described in the foregoing embodiment.

Figure 5:
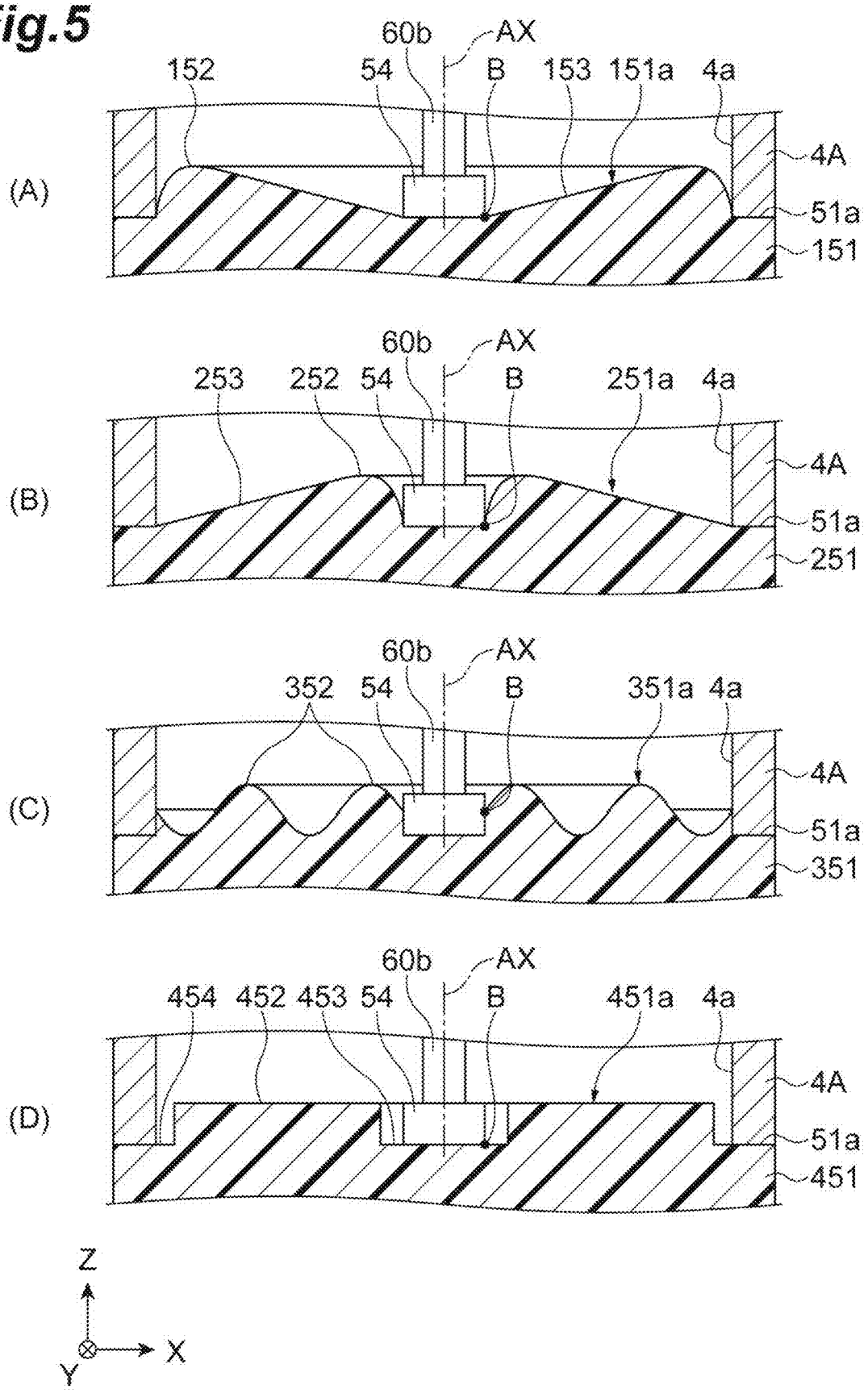
FIG. 5 is a view showing modification examples of insulating blocks.

FIG. 5 is a cross-sectional view showing upper surfaces of insulating blocks 151, 251, 351, and 451 according to modification examples. In the examples in FIG. 5, an opening end of a cylindrical X-ray tube accommodation portion 4A having no tapered portion 43 is bonded to the upper surface edge portions 51*a* of the insulating blocks 151, 251, 351, and 451. In this manner, the X-ray tube accommodation portion and the insulating block may be directly connected to each other or may be connected to each other with another member (in the foregoing embodiment, the upper wall portion 212) therebetween as in the foregoing embodiment.

An upper surface 151*a* of the insulating block 151 shown in (A) of FIG. 5 is formed to have a tapered shape (a shape inclined upward while it goes from the inward side toward the outward side) due to a protrusion portion 152 and an inclination portion 153. The protrusion portion 152 is a protrusion portion similar to the protrusion portion 55B of the foregoing embodiment. That is, the protrusion portion 152 is an annular protrusion portion provided such that an annular groove portion is formed between the protrusion portion 152 and the inner surface 4*a* at a position near the inner surface 4*a* of the X-ray tube accommodation portion 4A. An apex portion of the protrusion portion 152 is positioned below the end portion 12*b* of the insulating valve 12. The inclination portion 153 is a part connecting the boundary portion B and the protrusion portion 152 to each other. The inclination portion 153 is an inclined surface being inclined such that it is separated from the tube axis AX while it goes toward the X-ray tube 3 side (upward in FIG. 5) along the tube axis AX. Even on the upper surface 151*a* described above, the creepage distance is extended due to the protrusion portion 152 and the inclination portion 153 compared to the case in which the upper surface is a flat surface (for example, a plane passing through the boundary portion B and orthogonal to the tube axis direction (Z direction)). In addition, similar to the upper surface 51*e* of the foregoing embodiment, every part on the upper surface 151*a* is positioned below the end portion 12*b* (imaginary plane P) of the insulating valve 12. Therefore, similar to the insulating block 51 having the upper surface 51*e* of the foregoing embodiment, deterioration in cooling efficiency of the X-ray tube 3 can also be curbed by the insulating block 151 having the upper surface 151*a* while creepage discharging on the surface of the insulating block 151 is curbed.

An upper surface 251*a* of the insulating block 251 shown in (B) of FIG. 5 is formed to have an inversely tapered shape (a shape inclined downward while it goes from the inward side toward the outward side) due to a protrusion portion 252 and an inclination portion 253. The protrusion portion 252 is a protrusion portion similar to the protrusion portion 55A of the foregoing embodiment. That is, the protrusion portion 252 is an annular protrusion portion provided such that the high-voltage power supply unit 54 is surrounded in the vicinity of the high-voltage power supply unit 54. An apex portion of the protrusion portion 252 is positioned below the end portion 12*b* (imaginary plane P) of the insulating valve 12. The inclination portion 253 is a part connecting the protrusion portion 252 and the upper surface edge portion 51*a* to each other. The inclination portion 253 is an inclined surface being inclined toward the tube axis AX while it goes toward the X-ray tube 3 side (upward in FIG. 5) along the tube axis AX. Even on the upper surface 251*a* described above, the creepage distance is extended due to the protrusion portion 252 and the inclination portion 253 compared to the case in which the upper surface is a flat surface. In addition, similar to the upper surface 51*e* of the foregoing embodiment, every part on the upper surface 251*a* is positioned below the end portion 12*b* (imaginary plane P) of the insulating valve 12. Therefore, similar to the insulating block 51 having the upper surface 51*e* of the foregoing embodiment, deterioration in cooling efficiency of the X-ray tube 3 can also be curbed by the insulating block 251 having the upper surface 251*a* while creepage discharging on the surface of the insulating block 251 is curbed. In addition, the effect of curbing discharging in the boundary portion B is extremely high. Moreover, foreign substances or the like easily arrive at a side of the X-ray tube accommodation portion 4 having the ground potential (0 V) due to the inclined surface. For this reason, discharging caused by foreign substances or the like is unlikely to occur, and foreign substances can also be easily removed.

An upper surface 351*a* of the insulating block 351 shown in (c) of FIG. 5 is formed to have a waveform due to a plurality of annular protrusion portions 352 provided regularly from the inward side toward the outward side. Each of the protrusion portions 352 is provided in a concentric circular shape centering on the tube axis AX when viewed in the Z direction. The protrusion portion 352 (protrusion portion 352 on the innermost side) connected to the boundary portion B is provided such that the boundary portion B is surrounded. An apex portion of each of the protrusion portions 352 is positioned below the end portion 12*b* (imaginary plane P) of the insulating valve 12. Even on the upper surface 351*a* described above, the creepage distance is further extended due to the plurality of protrusion portions 352 compared to the case in which the upper surface is a flat surface. In addition, similar to the upper surface 51*e* of the foregoing embodiment, every part on the upper surface 351*a* is positioned below the end portion 12*b* (imaginary plane P) of the insulating valve 12. Therefore, similar to the insulating block 51 having the upper surface 51*e* of the foregoing embodiment, deterioration in cooling efficiency of the X-ray tube 3 can also be curbed by the insulating block 351 having the upper surface 351*a* while creepage discharging on the surface of the insulating block 351 is curbed.

An upper surface 451*a* of the insulating block 451 shown in (D) of FIG. 5 is formed to have a stepped shape due to a cylindrical protrusion portion 452 surrounding the high-voltage power supply unit 54. The protrusion portion 452 protrudes with respect to a plane (XY plane) passing through the boundary portion B and orthogonal to the tube axis direction (Z direction). Accordingly, an annular groove portion 453 is provided between the protrusion portion 452 and the high-voltage power supply unit 54, and an annular groove portion 454 is provided between the protrusion portion 452 and the inner surface 4*a* of the X-ray tube accommodation portion 4A. An apex portion of the protrusion portion 452 is positioned below the end portion 12*b* (imaginary plane P) of the insulating valve 12. Even on the upper surface 451*a* described above, the creepage distance is extended due to the protrusion portion 452 compared to the case in which the upper surface is a flat surface. Specifically, the creepage distance is longer than that on a flat surface by the length of the side surface of the protrusion portion 452 (the inner surface for forming the groove portion 453 and the outer surface for forming a groove portion 454). In addition, similar to the upper surface 51*e* of the foregoing embodiment, every part on the upper surface 451*a* is positioned below the end portion 12*b* (imaginary plane P) of the insulating valve 12. Therefore, similar to the insulating block 51 having the upper surface 51*e* of the foregoing embodiment, deterioration in cooling efficiency of the X-ray tube 3 can also be curbed by the insulating block 451 having the upper surface 451*a* while creepage discharging on the surface of the insulating block 451 is curbed. In addition, the protrusion portion can be easily formed.

In addition, the shape of an upper surface of an insulating block is not limited to the particular upper surface shapes (upper surfaces 51*e*, 151*a*, 251*a*, 351*a*, and 451*a*) described above and may be a shape in which the shapes of the surfaces described above are arbitrarily combined.

In addition, the X-ray tube 3 of the foregoing embodiment is a reflection X-ray tube drawing out X-rays in a direction different from an electron incidence direction with respect to a target, but it may be a transmission X-ray tube drawing out X-rays in the electron incidence direction with respect to a target (in which X-rays generated in a target are transmitted through the target itself and are drawn out through an X-ray emission window). In addition, in the X-ray tube 3 of the foregoing embodiment, the X-ray emission window 33*a* is formed above the target T, and the electron gun 11 is disposed on a lateral side of the target T, but a method of drawing out X-rays may be a so-called side window method (that is, a method in which an X-ray emission window is provide on a lateral side of the target T). Specifically, an electron gun emitting electrons to the target T in the tube axis direction may be disposed at a position where the X-ray emission window 33*a* is provided (that is, above the target T), and an X-ray emission window may be disposed at a position where the electron gun 11 is provided (that is, on a lateral side of the target T).

REFERENCE SIGNS LIST

1 X-ray generator
3 X-ray tube
4 X-ray tube accommodation portion
4*a* Inner surface
5 Power source unit
12 Insulating valve (valve portion)
45 Insulating oil (insulating liquid)
60*b* Base end portion (high-voltage application portion)
51, 151, 251, 351, 451 Insulating block
51*e*, 151*a*, 251*a*, 351*a*, 451*a* Upper surface (surface)
52 Internal substrate (high-voltage generation circuit)
54 High-voltage power supply unit (power supply unit)
55 Protrusion portion
55A Protrusion portion (first protrusion portion)
55B Protrusion portion (second protrusion portion)
56 Groove portion
57 Recess portion
58 Inclination portion
AX Tube axis
B, B2 Boundary portion

The invention claimed is:

1. An X-ray generator comprising:

an X-ray tube having a valve portion and a high-voltage application portion provided in the valve portion in a protruding manner;

an X-ray tube accommodation portion accommodating the valve portion such that at least the valve portion is surrounded when viewed in a tube axis direction along a tube axis of the X-ray tube; and a power source unit having a high-voltage generation circuit supplying a voltage to the X-ray tube sealed inside a solid insulating block made of an insulative material, wherein an insulating liquid is enclosed in a space defined by a surface of the insulating block facing the X-ray tube and an inner surface of the X-ray tube accommodation portion, wherein a conductive power supply unit electrically connected to the high-voltage application portion is disposed on the surface of the insulating block, wherein at least one protrusion portion protruding to the valve portion side beyond a boundary portion where the power supply unit, the surface of the insulating block, and the insulating liquid meet and surrounding the power supply unit when viewed in the tube axis direction is provided on the surface of the insulating block, and wherein an apex portion of the at least one protrusion portion is separated from an imaginary plane including an end portion of the valve portion on the surface side and extending in a direction orthogonal to the tube axis.

2. The X-ray generator according to claim 1, wherein the surface of the insulating block has a surface shape varying continuously.

3. The X-ray generator according to claim 1, wherein the at least one protrusion portion includes a first protrusion portion having an annular shape surrounding the power supply unit in the vicinity of the power supply unit.

4. The X-ray generator according to claim 1, wherein the at least one protrusion portion includes a second protrusion portion having an annular shape forming a groove portion between the second protrusion portion and the inner surface of the X-ray tube accommodation portion.

5. The X-ray generator according to claim 1, wherein an annular recess portion surrounding the power supply unit and an inclination portion connected to the recess portion and being inclined toward the recess portion while being separated from the imaginary plane in the tube axis direction are provided on the surface of the insulating block.

* * * * *